US005766420A

United States Patent [19]

Cabrera y Lopez Caram

[11] Patent Number: 5,766,420

[45] Date of Patent: Jun. 16, 1998

[54] UNDER FELT INCLINED FLAT FORMER TO PRODUCE MULTILAYER OR MONOLAYER SHEET OF PAPER

[75] Inventor: Luis Fernando Cabrera y Lopez Caram, Cuernavaca, Mexico

[73] Assignee: Smurfut Carton y Papel De Mexico, Polanco, Mexico

[21] Appl. No.: 709,510

[22] Filed: Sep. 6, 1996

Related U.S. Application Data

[63] Continuation-in-part of Ser. No. 236,451, May 2, 1994, abandoned.

[51] Int. Cl.[6] ..... D21F 9/02; D21F 1/02

[52] U.S. Cl. ..... 162/354; 162/289; 162/348; 162/352; 162/304; 162/344

[58] Field of Search ..... 162/304, 352, 162/133, 273, 274, 336, 337, 338, 339, 340, 341, 342, 343, 344, 300, 301, 306, 199, 214, 289, 354, 348

[56] References Cited

U.S. PATENT DOCUMENTS

| | | | |
|---|---|---|---|
| 1,481,163 | 1/1924 | Van de Car, Jr. | 162/347 |
| 2,755,710 | 1/1956 | Beachler | 162/273 |
| 2,894,581 | 1/1959 | Goumeniouk | 162/339 |
| 3,328,236 | 6/1967 | Burgess, Jr. et al. | 162/342 |
| 3,357,880 | 12/1967 | Curtis | 162/344 |
| 3,743,574 | 7/1973 | Walser et al. | 162/352 |
| 3,770,580 | 11/1973 | Kallmes et al. | 162/141 |
| 3,795,576 | 3/1974 | Watanabe | 162/318 |
| 3,823,062 | 7/1974 | Ward et al. | 162/126 |
| 3,902,960 | 9/1975 | Zentner et al. | 162/199 |
| 3,923,595 | 12/1975 | Tokuno | 162/300 |
| 3,976,539 | 8/1976 | Kirjavainen | 162/344 |
| 3,989,587 | 11/1976 | Grossmann | 162/200 |
| 4,004,969 | 1/1977 | Beauchemin | 162/352 |
| 4,024,016 | 5/1977 | Gordon et al. | 162/214 |
| 4,100,018 | 7/1978 | Wahren et al. | 162/203 |
| 4,220,502 | 9/1980 | Levanen | 162/273 |
| 4,306,934 | 12/1981 | Seppanen | 162/209 |
| 4,331,511 | 5/1982 | Goddard et al. | 162/352 |
| 4,425,189 | 1/1984 | Mimura | 162/352 |
| 4,683,027 | 7/1987 | Pikajarvi | 162/199 |
| 4,687,549 | 8/1987 | Kallmes | 162/352 |
| 4,789,433 | 12/1988 | Fuchs | 162/352 |
| 4,838,996 | 6/1989 | Kallmes | 162/35 |
| 5,242,547 | 9/1993 | Corbellini et al. | 162/351 |
| 5,300,196 | 4/1994 | Kraft | 162/300 |
| 5,522,969 | 6/1996 | Corbellini et al. | 162/211 |

FOREIGN PATENT DOCUMENTS

| | | |
|---|---|---|
| 2215130 | 3/1972 | Denmark . |
| 2453095 | 4/1980 | France . |
| 187711 | 3/1906 | Germany . |
| 513066 | of 1971 | Switzerland . |
| 1722064 | 7/1971 | U.S.S.R. . |
| 2243599 | 6/1991 | United Kingdom . |
| 9325753 | 12/1993 | WIPO . |

*Primary Examiner*—Donald E. Czaja
*Assistant Examiner*—Jose A. Fortuna
*Attorney, Agent, or Firm*— Kane, Dalsimer, Sullivan, Kurucz, Levy, Eisele and Richard, LLP

[57] ABSTRACT

An under felt inclined flat former for making multilayer or monolayer sheets of paper comprising a plurality of forming units arranged along a production line. Each of the forming units is supported on corresponding rigid supports and is provided with a roller system on which the forming unit or a portion thereof rests which when the supports are removed, the selected forming unit or portion thereof can be removed from the production line for cleaning or maintenance purposes, without interrupting the operation of the former equipment. Each forming unit including means to create activity in the stock in addition to causing liquid to be drained therefrom for sheet formation.

24 Claims, 15 Drawing Sheets

UNDER FELT INCLINED FLAT FORMER TO PRODUCE MULTILAYER OR MONOLAYER SHEET OF PAPER

RELATED APPLICATION

This is a continuation-in-part of U.S. patent application Ser. No. 08/236,451 filed May 2, 1994, now abandoned the disclosure of which is incorporated herein by reference.

FIELD OF THE INVENTION

The equipment of the present invention serves to form a sheet of paper under the felt line or papermakers fabric, this sheet can be for monolayer or multilayer paper. The paper sheet so formed has superior characteristics to that of a sheet made in a fourdrinier manufacturing table.

SUMMARY OF THE INVENTION

Fiber suspension is distributed through a head box over a forming table, allowing the fiber a freely orient according to the jet/fabric speeds rate, and to the hydraulic pattern generated by a forming activity lip.

The effect generated by the activity lip is supplemented in a first embodiment by a pulse forming roll or allowing the fibers to orient freely or in a controlled fashion according to the roll speed. The water remaining in the fiber suspension is drained in a box divided in three vacuum compartments, to reach a fixed dryness to make contact with a prior unit sheet or with the felt in the case of being the first unit.

The equipment comprises a forming table in which the tilt can be adjusted according to manufacturing requirements. This forming table comprises a fabric to form the paper sheet, a breast roll also serving as fabric stretcher, forming and dewatering foils, a pulse forming roll, flat boxes, a cylinder or support mold, a guide roll and control elements, support structures to support the former equipment, head box water collection trays, and rails and rollers for maintenance of the former equipment, to allow the unit to be removed from service without halting production. The equipment also comprises a fiber distribution head box oriented towards the formation table, as well as a suction slider to extract water from the inner part of the felt. It also is provided with a rubber couch roll which presses the felt and the sheet in such a manner that the paper sheet adheres to the felt and can be transferred to the next formation unit. The couch roll is provided with a mechanism for setting position against the cylinder mold, as well as with a bellows system to raise the couch roll or to apply pressure against said cylinder mold. The equipment comprises showers to keep clean the support roll, the fabric and the breast roll. A doctor blade is located in the breast roll for keeping the roll clean and to divert the water drained in this zone to a tray. This unit has a system comprising two vertical structures and a lengthwise beam to provide rigidity thereto.

In a second embodiment, the forming table is essentially the same as that described except substituted for the flat boxes are drainage blades which allow for drainage and activity formation. This eliminates the use of a pulse forming roll among other advantages that will be discussed. In addition, a variation of the head box is provided which has a means for adjusting the position of a modified upper activity lip with respect to the fabric. Other differences in the two embodiments will be readily apparent from the discussion herein.

BACKGROUND OF THE INVENTION

Currently there are several types of multilayer paper formation equipments among which the following can be mentioned:

CYLINDER MACHINE, this machine forms the paper sheet draining the water through a mesh screen adhered to a cylinder. The formed sheet is transferred directly to a felt for further joining the next layer. In this machine there is no control on the fiber orientation nor in the draining speed of the fiber suspension.

FLAT FORMERS OVER FELT LINE, these farmers have a flat table in the area of formation of the paper sheet, which once the paper sheet is formed, it is transferred to a felt completely surrounding the forming felt to thereafter pass under this formation unit and arrive to the next formation unit. Most of the equipments of the prior art has several disadvantages, such as: inadequate formation, non-adjustable MD/CD tensile ratio, tendency to curl with sheeted paper, non-uniform CD profile (streaks), drop-off and speed limitations among others.

The present invention is intended to overcome the defects of the prior art devices, having further advantages, since it allows control on the fiber orientation in a former equipment under the felt line. It also allows to stop a formation unit and the complete or partial removal thereof from the production line without shutting down the production process.

BRIEF DESCRIPTION OF THE DRAWINGS

Thus by the present invention its advantages over the prior art will be apparent, the description of which should be taken in conjunction with the drawings, wherein.

DETAILED DESCRIPTION OF THE PREFERRED EMBODIMENTS

Figure 1:
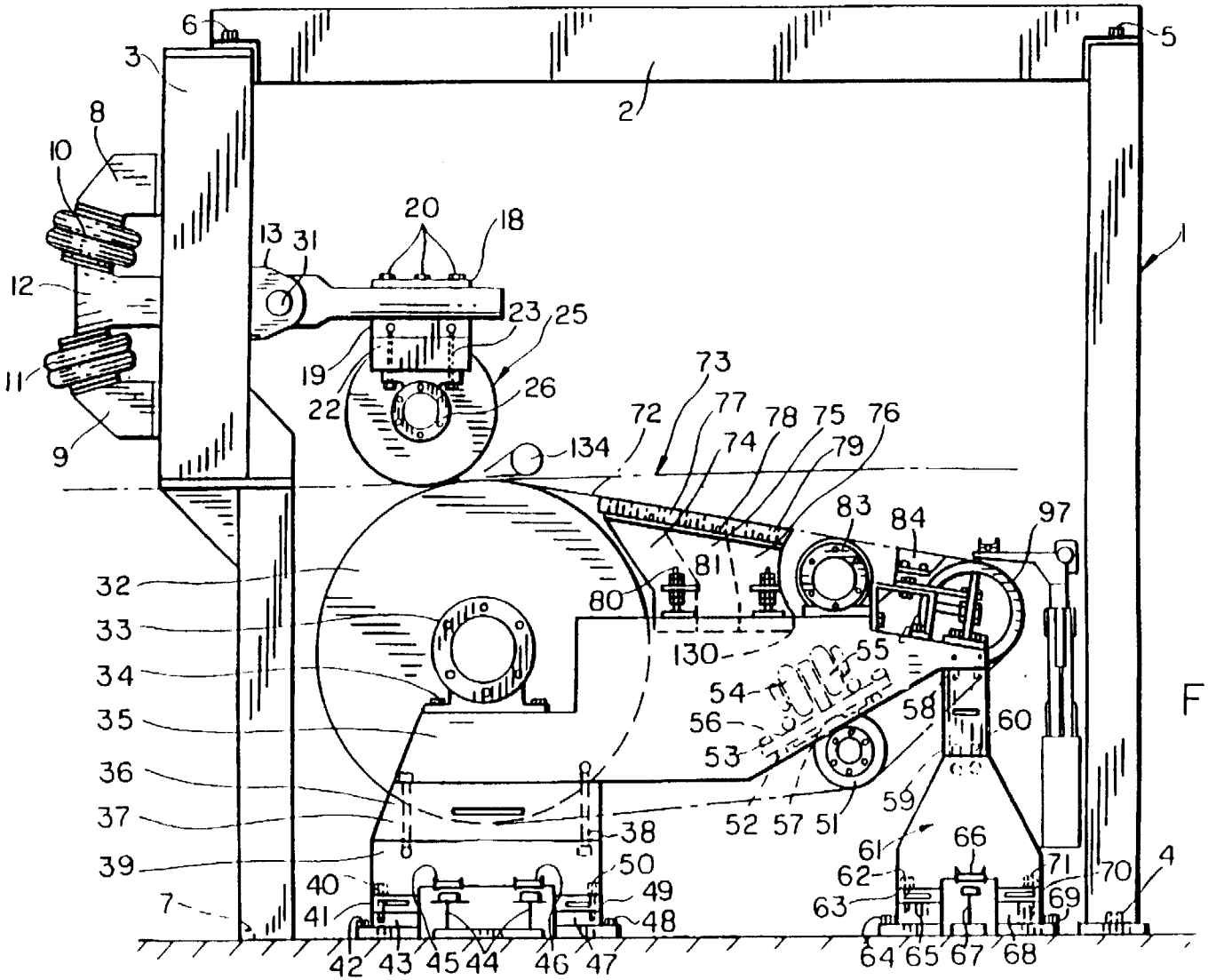
FIG. 1 is an elevation view of the paper former showing all its constituents.
Figure 2:
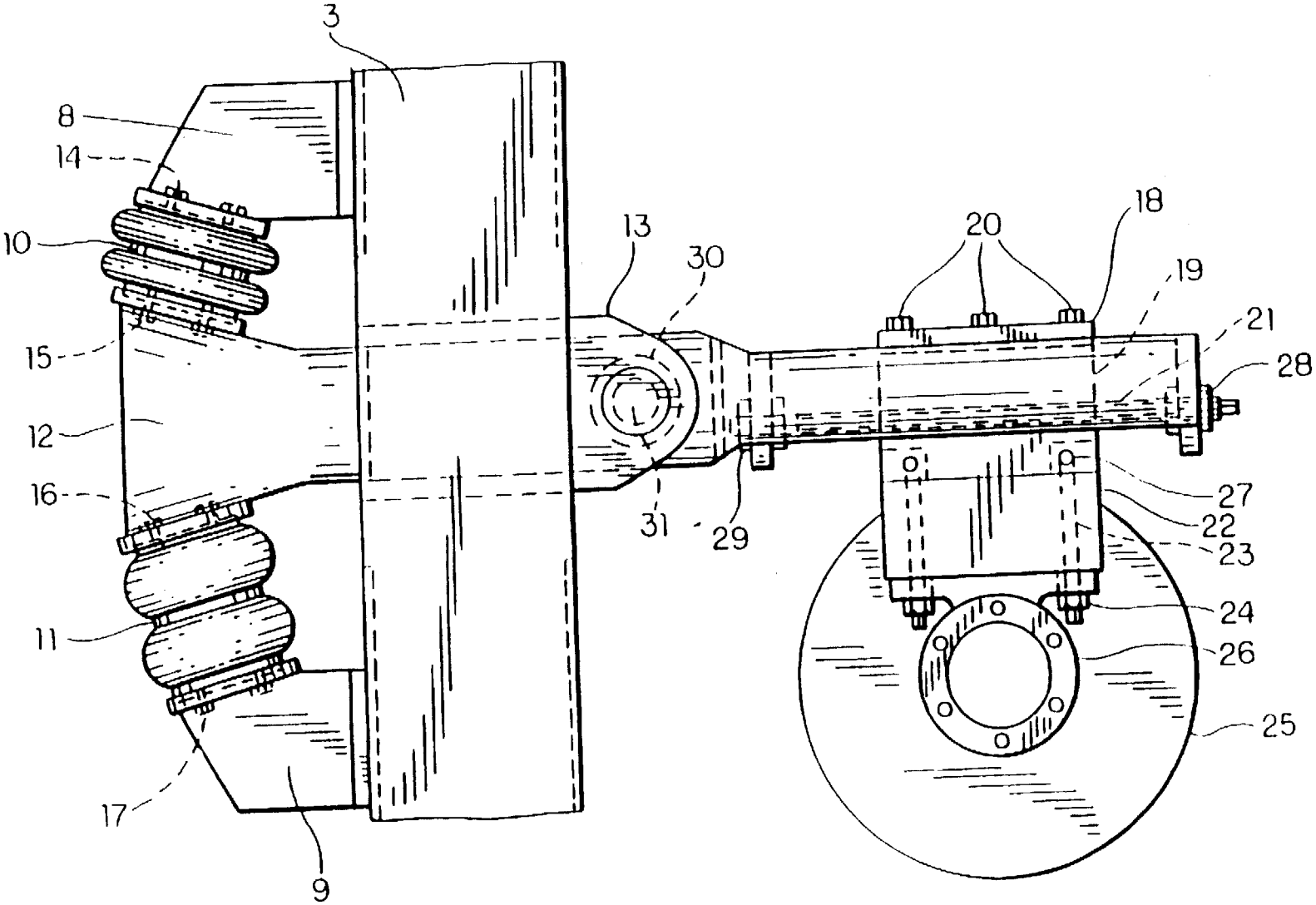
FIG. 2 is a detail of the couch roll with all the mechanisms thereof.

With reference to the embodiment shown in FIGS. 1–7, the equipment of the present invention comprises a vertical frame (1) anchored in its lower part by screws (4) and also comprises a second frame (3) anchored in the lower part to the floor by screws (7). A beam (2) is located in the top part of both frames, joining both frames by means of screws (5) and (6). In the second frame (3), at the exit side of the paper sheet, there is located a mechanism for applying pressure or for raising the couch roll (25). This mechanism comprises two supports (8) and (9), each of them has a corresponding rubber pneumatic bellows (10) and (11) joined thereto. As can be seen in FIG. 2, the upper pneumatic bellows (10) is joined to the top part of the support (8) by screws (14) and to the lower part to an arm (12) that is attached to the couch roll by means of screws (15). The upper bellows (10) has as a function to raise the couch roll. The pneumatic lower bellows (11) is attached in the lower part to the support (9) by means of screws (17) and in the top part is attached to the arm (12) by means of screws (16). A support (13) is joined to the frame (3). The support (13) carries a bearing (30) in its central portion; said bearing houses a pin (31), that acts as a fulcrum for the arm (12) which fastens the couch roll by means of a support (18) that in turn is attached to a supporting block (19) through screws (20). The supporting block (19) has a threaded hole in the central part thereof. This block adjusts its position by means of a spindle (21) fixed to the arm (12) by means of dividers (28) and (29). The supporting block (19) is attached to the journal bearing (26) that supports the couch roll 25 by means of rotating screws (23) and a separating block (22).

The rotating screws (23) press the journal bearing of the couch screw by means of a nut (24) and rotate by means of a pin (27) fixed to the block (19).

Referring to FIG. 1, the equipment of the present invention also comprises a suction slider (134) that extracts the water from the sheet of paper and the felt when being pressed between the couch roll (25) and the cylinder or support roll (32). Note that of the present invention is replacing a cylinder machine, the cylinder roll of that machine may advantageously be incorporated in the inclined former rather then discarded.

Figure 3:
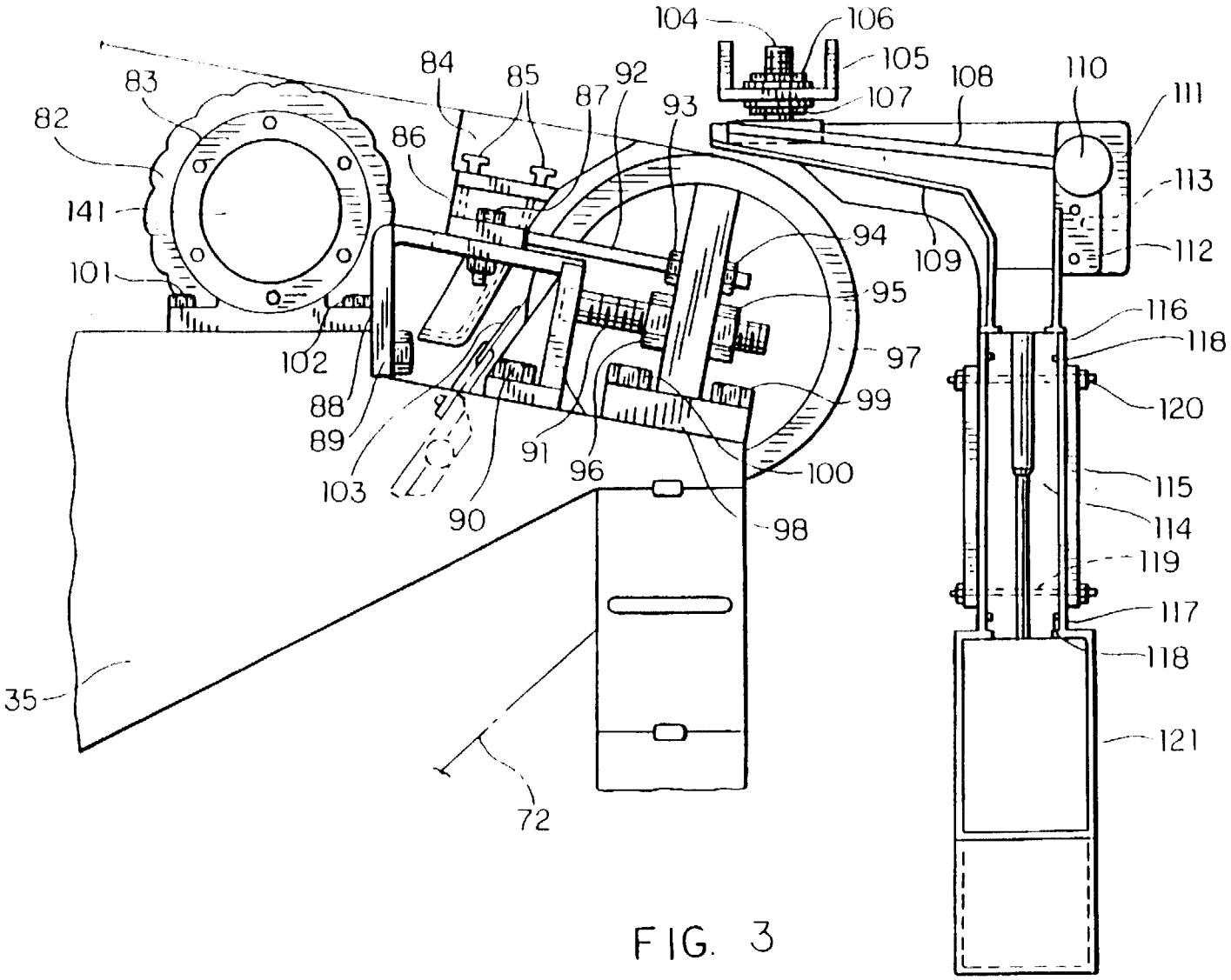
FIG. 3 shows a detail of the breast roll, the forming knife and the head box also with all their components.

In FIG. 3 it is shown that this equipment also comprises a breast roll (97), a former roll (83) a flat box with three compartments (74), (75) and (76) having corresponding high density polyethylene covers (77), (78) and (79) in their upper part. It also has a cylinder or support mold or roll (32) and a fabric lead roll (51), as well as a formation fabric (72).

The flat box with three compartments (74), (75) and (76) is attached to the main structure (35) by means of screws (80) and (81) that in turn allows alignment and leveling of the box. The flat box has a plate (130) which avoids that the water drained from the former fabric (72) adhere to the inner part of the flat box compartments. The cylinder mold (32) rotates on a bearing housed in a journal bearing (33). This journal bearing is attached to a main structure (35) by means of screws (34). The main structure (35) is supported by means of two blocks (37) and (60) which in turn are attached to the bases (39) and (61) of the former equipment. These bases are attached to the supports (43), (47), (65) and, (68) by means of spacer blocks (41), (49), (63) and (70). A removable block (37) is attached to the base (39) and to the main structure (35) by means of two rotating screws (36) and (38). A second removable block (60) is attached to the structure and support (61) by means of rotating screws (58) and (59). The removable blocks (37) and (60) serve to keep the whole formation unit in such a way that when it is required to change the formation fabric (72), said blocks are merely removed while the whole unit remains in cantilever allowing to carry out set up of the new fabric in a minimum time. The support (39) which is located immediately below the support roll is attached to the bases (43) and (47) by means of spacers (41) and (49) held by screws (40) and (50). The support (61) which is immediately below the breast roll is attached to the bases (65) and (68) by means of spacers (63) and (70). These supports are held by means of screws (62) and (71).

The equipment of the present invention has a roller system (45), (46) and (66) which allows the unit to sit on rails (44) and (67) when the spacer blocks (63), (70), (49) and (41) are removed from the supporting position. This allows the unit to be completely removed from the machine without stopping production by merely pulling the former away from its operating position.

This unit has a system for controlling the position of the formation fabric (72) by means of a guide roll (51). The mechanism for operating this guide roll operates as follows: the guide roll (51) is supported by a journal bearing (57), this journal bearing is attached to a support plate (56), which is actuated by two pneumatic adjusting bellows (54) and (55), the support plate (56) is kept in position by the rolls (52) and (53), such rolls maintain the horizontal and vertical position of the support plate. The adjusting bellows (54) and (55) adjust the position of the guide roll (51) by changing the pneumatic pressure in each one of said bellows.

This equipment comprises a former roll (83), attached to the main structure (35) by means of screws (101), which fix the journal bearing (141) about which the former roll rotates to said structure.

Figure 6:
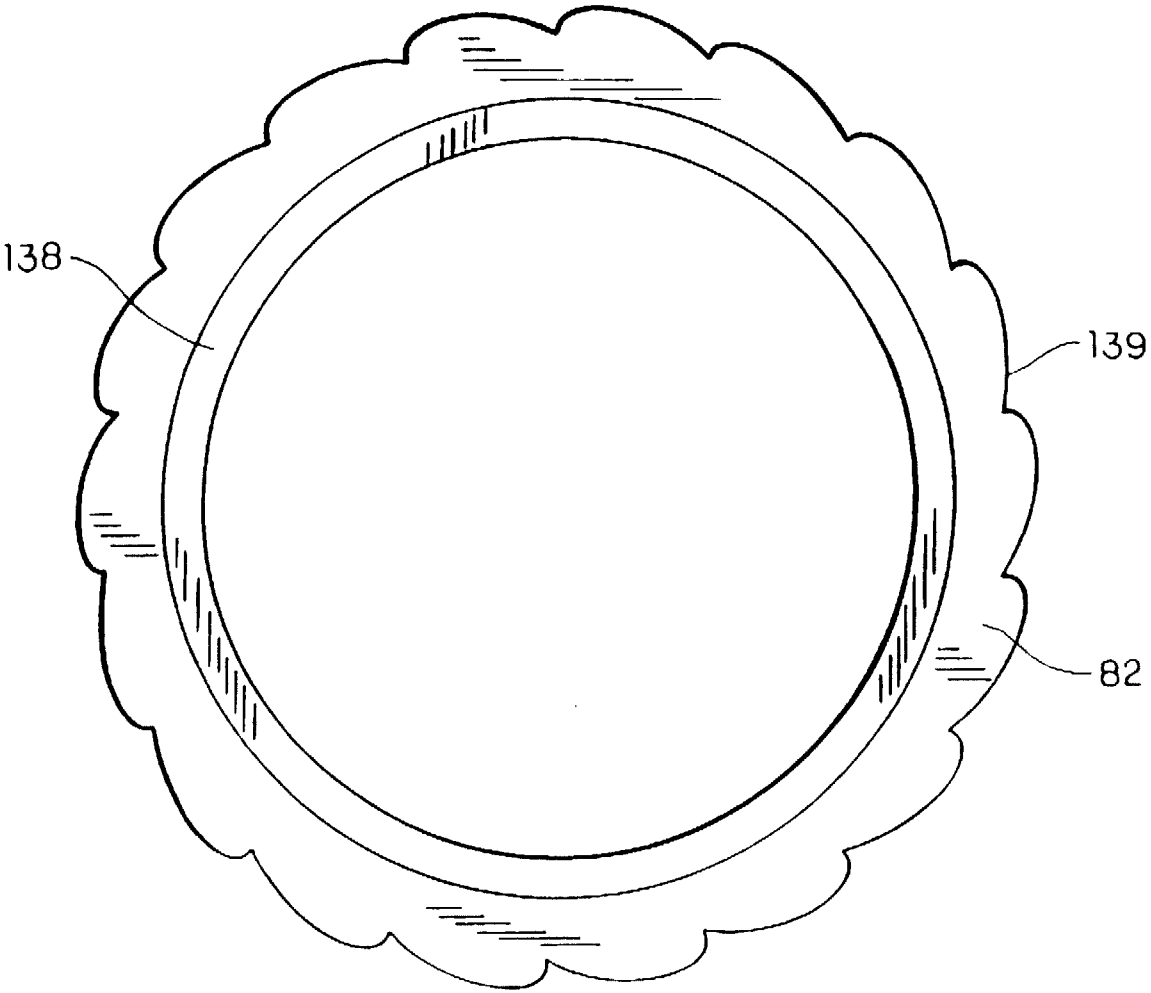
FIG. 6 illustrates a side view of the forming roll.
Figure 7:
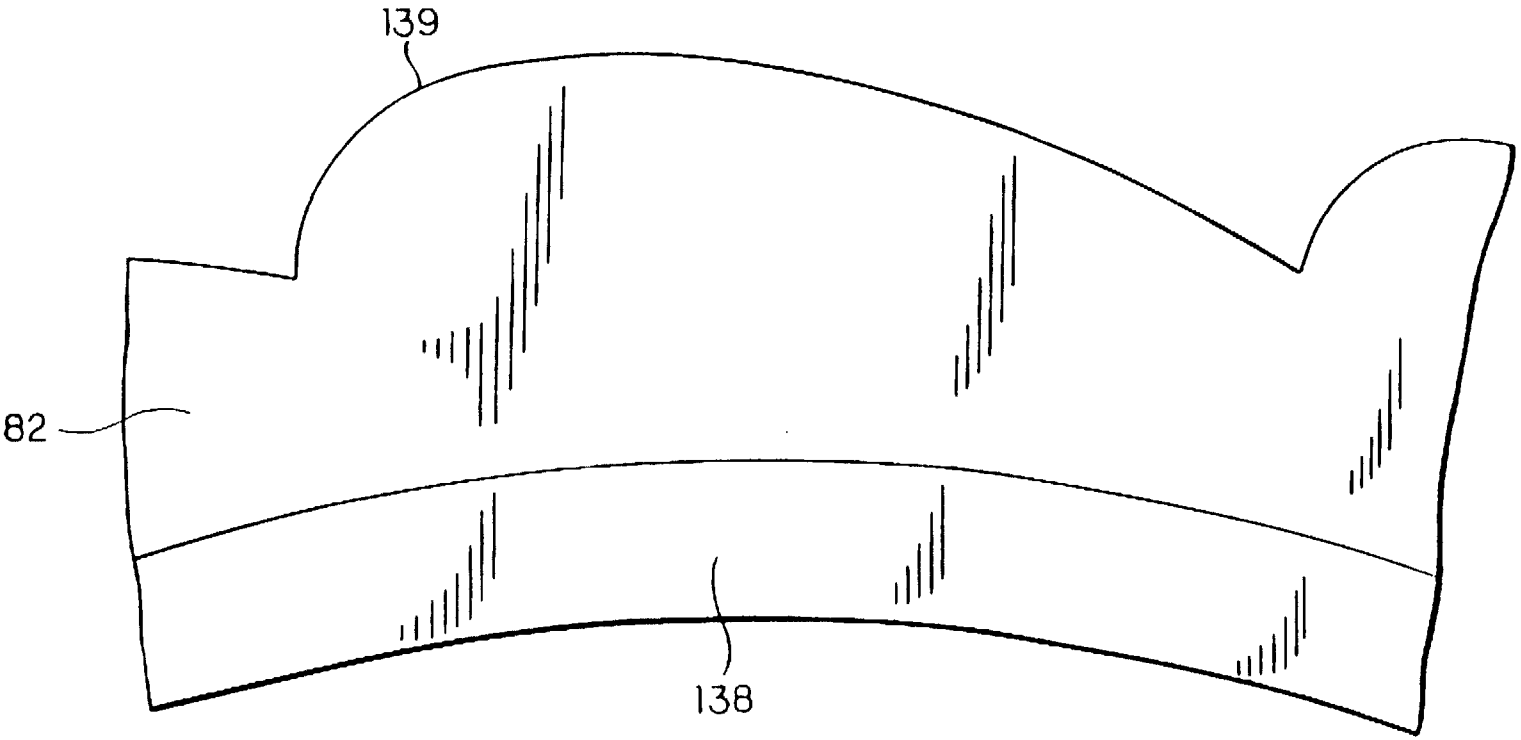
FIG. 7 illustrates a detail of the forming roll vane.

As shown in FIGS. 6 and 7 the former roll is built with a steel core (138) which is coated with a resin (83) whose surface is machined to provide thereto a streamline profile (139), which allows the generation of a positive pulse in the first contact with the fabric and a negative pulse at the time when this profile loses contact with the formation plastic fabric. The peripheral speed of the roll is lower to that of the formation fabric allowing injection of water from the lower part of the fabric to the upper part where the fiber suspension is, creating thus a rearrangement of the fibers.

The breast roll (97), shown in FIG. 3, rotates over bearings located in a journal bearing (98), which is attached to the main structure (35) by means of screws (99) and (100). Adjustment of the position of the breast roll is carried out with a spindle (91) by means of nuts (95) and (96). The spindle (91) is attached to a structure (88) which also supports the base of the formation knives (86). The base is attached to the structure (88) by means of a screw (87). The position of the base of the formation knives against breast rolls is adjusted by means of a spindle (92) and retaining nuts (93) and (94).

The structure (88) is attached to the main structure (35) by means of screws (89) and (90), the structure of the formation knives holds the formation knife (84) by means of T-shaped sliders (85).

A plastic knife (103) is provided to keep clean the breast roll (97), the plastic knife (103) plays a cleaning role and at the same time deviates the water drained by the breast roll towards a collecting tray (128).

As shown in FIG. 3, the formation equipment comprises a flow head box, which comprises a conical manifold (121) whose function is to distribute uniformly the flow of the fiber suspension in a direction widthwise to the formation unit. Attached to this conical manifold by means of a throat (117), is a stepped diffuser (114) that is sealed in the lower and upper part by means of a plastic tube (118). To avoid flexing of the stepped diffuser, there is provided a plate (115) that covers completely the diffuser. The plate (115) is attached to the manifold and to the upper part of the head box by screws (119) and (120). The main role of the stepped diffuser is to maintain the fibers in a state of complete dispersion.

Figure 4A:
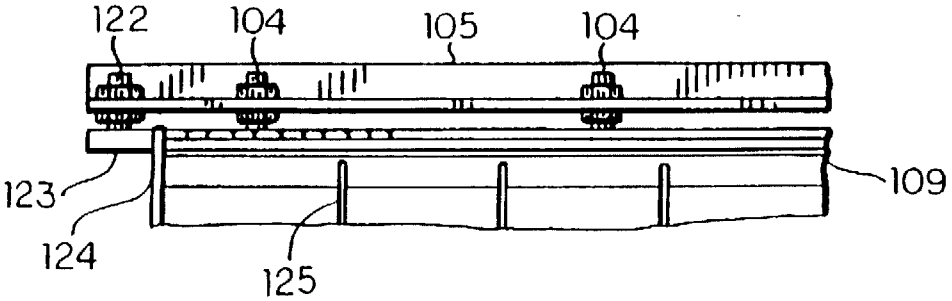
FIGS. 4*a*, 4*b* and 4*c*, illustrate the activity lip as well as all the components thereof.
Figure 4B:
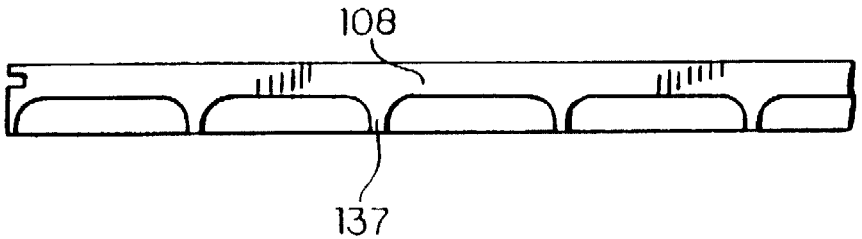
Figure 4C:
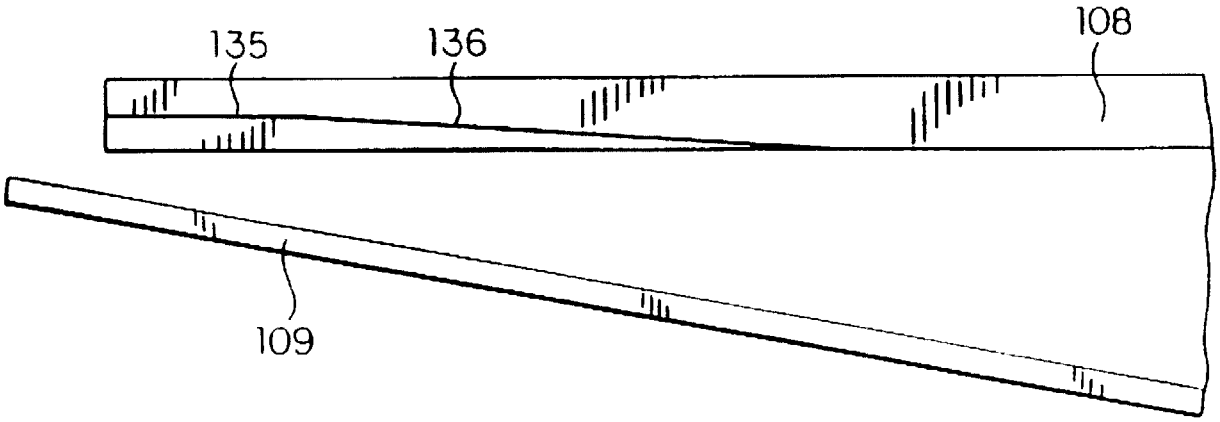

As illustrated in FIGS. 4A, 4B and 4C, the head box has a lower lip (109) and an upper activity lip (108). The upper lip sets its opening position to control the discharge flow by means of screws (122) located at the ends of the head box. The box profile is adjusted by screws (122) located in the internal part of the head box, in both cases the screws are adjusted by means of retaining nuts and (104). Internal (104) and external (122) screws are attached to a bridge (105) allowing uniform movement of the lip.

As illustrated in FIG. 3, at the opposite end, the upper activity lip (108) has a universal joint (110) supported over a plate (112) and to a retaining unit (111). This allows the upper activity lip (108) to move freely without fiber suspension leaks. The discharge end of the upper activity lip has a profile designed to create activity in the fiber suspension and which is able to orient high concentration of fibers; it also allows obtaining a paper of lower density. The profile is comprised of a inclined part (136) and a straight part (135), that make a change in the speed in the flow of the fiber suspension, both horizontally and vertically. The activity profile is spaced widthwise of the head box by means of sectors (137), (illustrated in FIG. 4B), keeping the same thickness of the upper activity lip. The upper activity lip internally generated hydraulic pattern produces cross flows over the forming table at the time the fiber suspension leaves the head box. This causes the fiber orientation to be improved transversely, that is the fiber orientation ratio in the machine direction to the transversa fiber orientation decreases. In this way, the values of the physical properties of the paper in the transversal sense tend to be similar to those in the machine sense.

Figure 5:
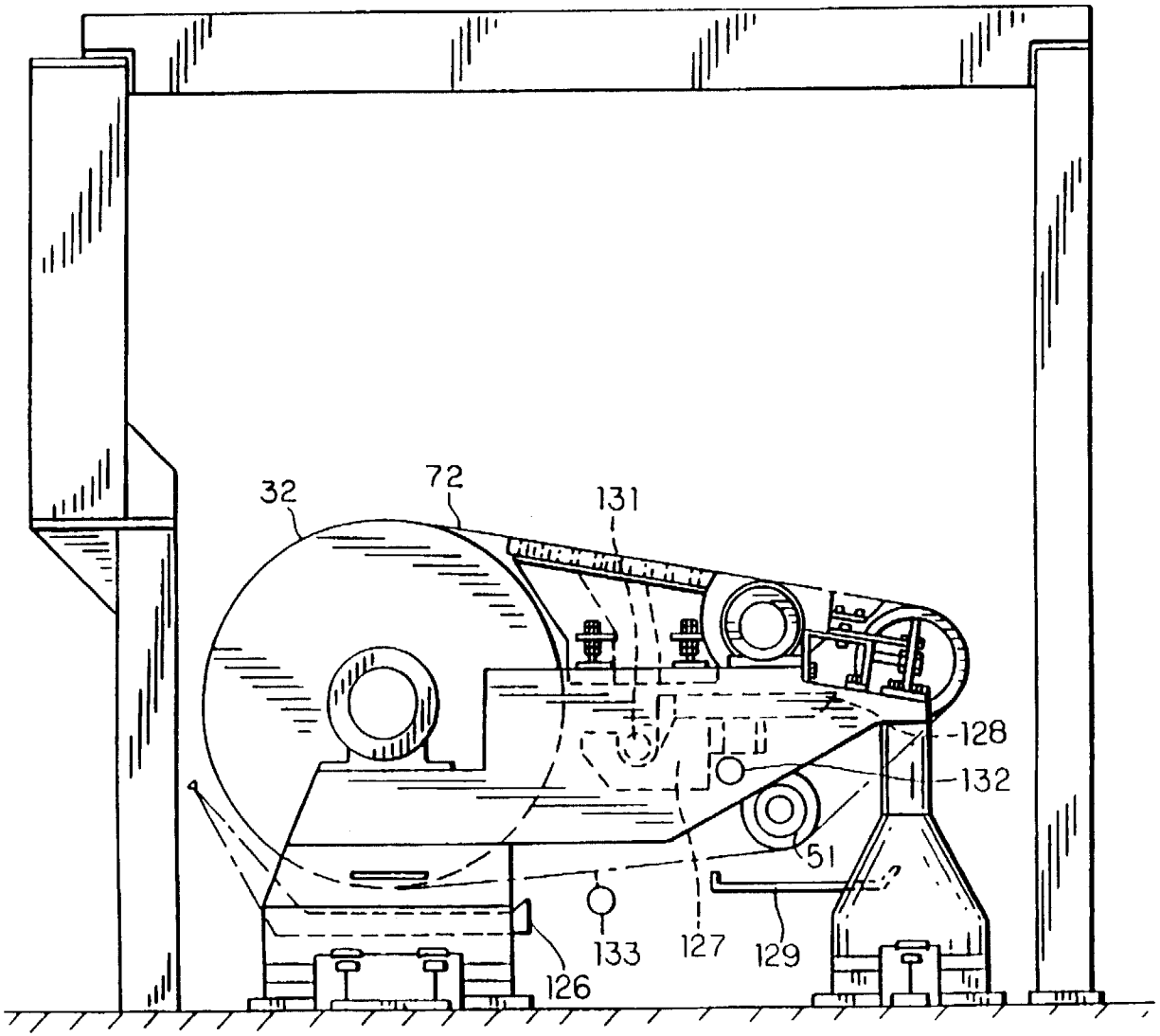
FIG. 5 illustrates the water collecting trays and showers forming part of the formation unit.

As shown in FIG. 5, a shower (131) keeps the cylinder mold (32) clean. There is also second shower (132) to keep the guide roll (51) clean. The formation fabric (72) is kept clean by means of a high pressure shower (133).

To collect the drained water in the unit there are a series of trays (127), (128), (129) and (126) collecting such water and driving it to an independent tank.

Turning now to the embodiment of the invention shown in FIGS. 8–13, like parts to those previously described have been similarly numbered and designated with a prime. The frame is essentially the same with a single second member (150) being substituted for the composite member (3). Beam (2') supports the suction slider (134') by way of an adjustable support member (151) which may be configured in any manner suitable for purpose.

The couch roll (25') is supported by the frame (150) in a manner as here before described. A cylinder or support roll (32') is provided supported by a base (152). As distinct from the prior embodiment, a main structure (153) is provided which is fixedly mounted and coupled to base (152) via a removable beam (154). The support roll (32') and base (152) can be pulled away from the forming unit upon the removal of spacer blocks (41' and 49') and beam (154) for servicing, replacement or any other reason its is found unnecessary to do so.

The main structure (153) includes a downwardly extending leg (155) and a horizontal frame (156) which is coupled to a base (157) which supports the breast roll (97'). Leg (155) and base (157) are fixedly mounted via bolts (158, 159, 160, 161). Removable spacer blocks (371, 162, 60') which when removed allows for the formation fabric (72') to be replaced. Of course, when such blocks are removed, the elements they support must be maintained in position by way of, for example, a cantilever means positioned temporarily on either side of the machine, (i.e. the sides looking into or out of FIG. 8).

Figure 8:
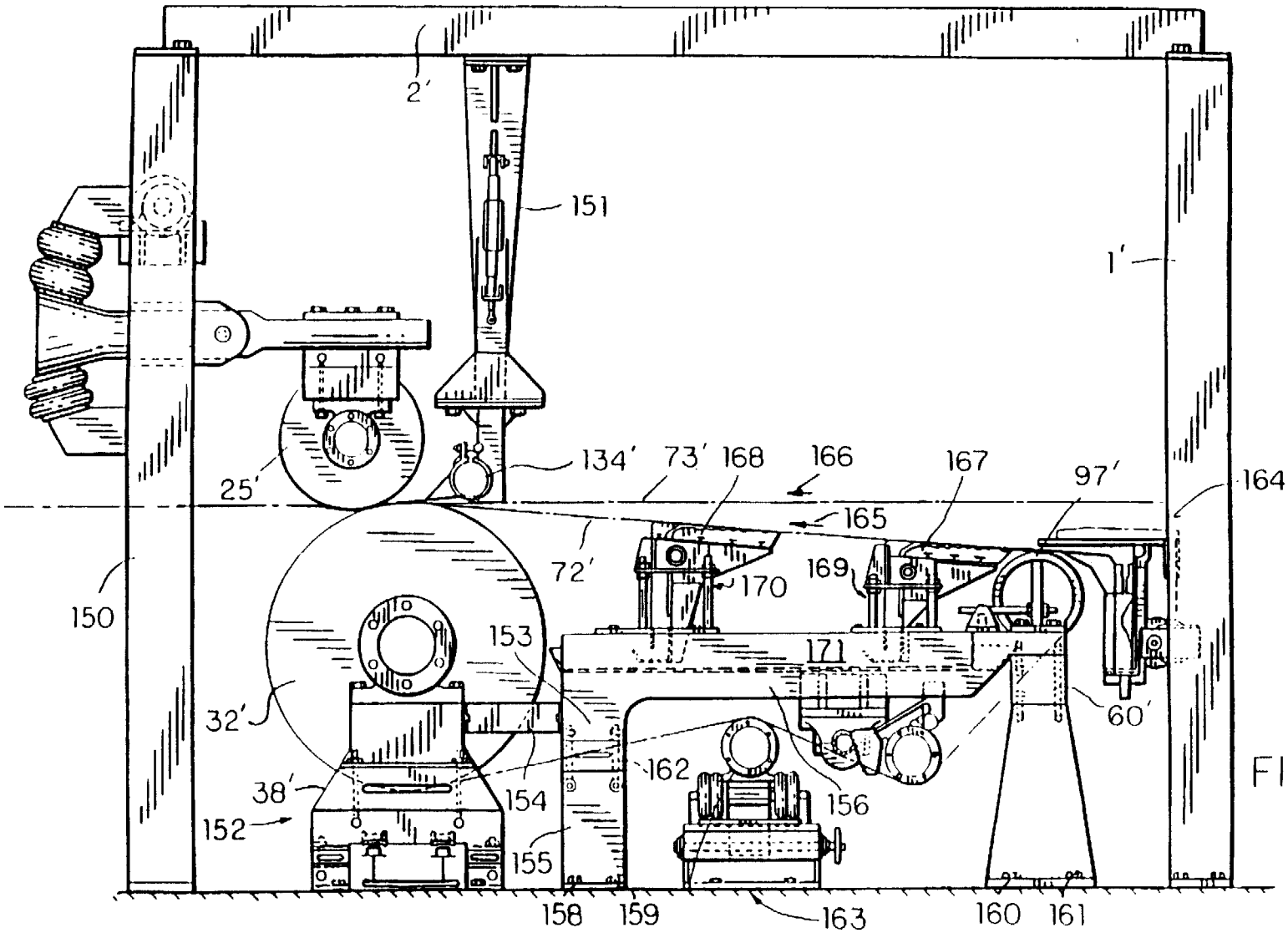
FIG. 8 is an elevation view of the paper former incorporating the drainage and forming blades and head box along with all of the other constituents thereof.
Figure 9:
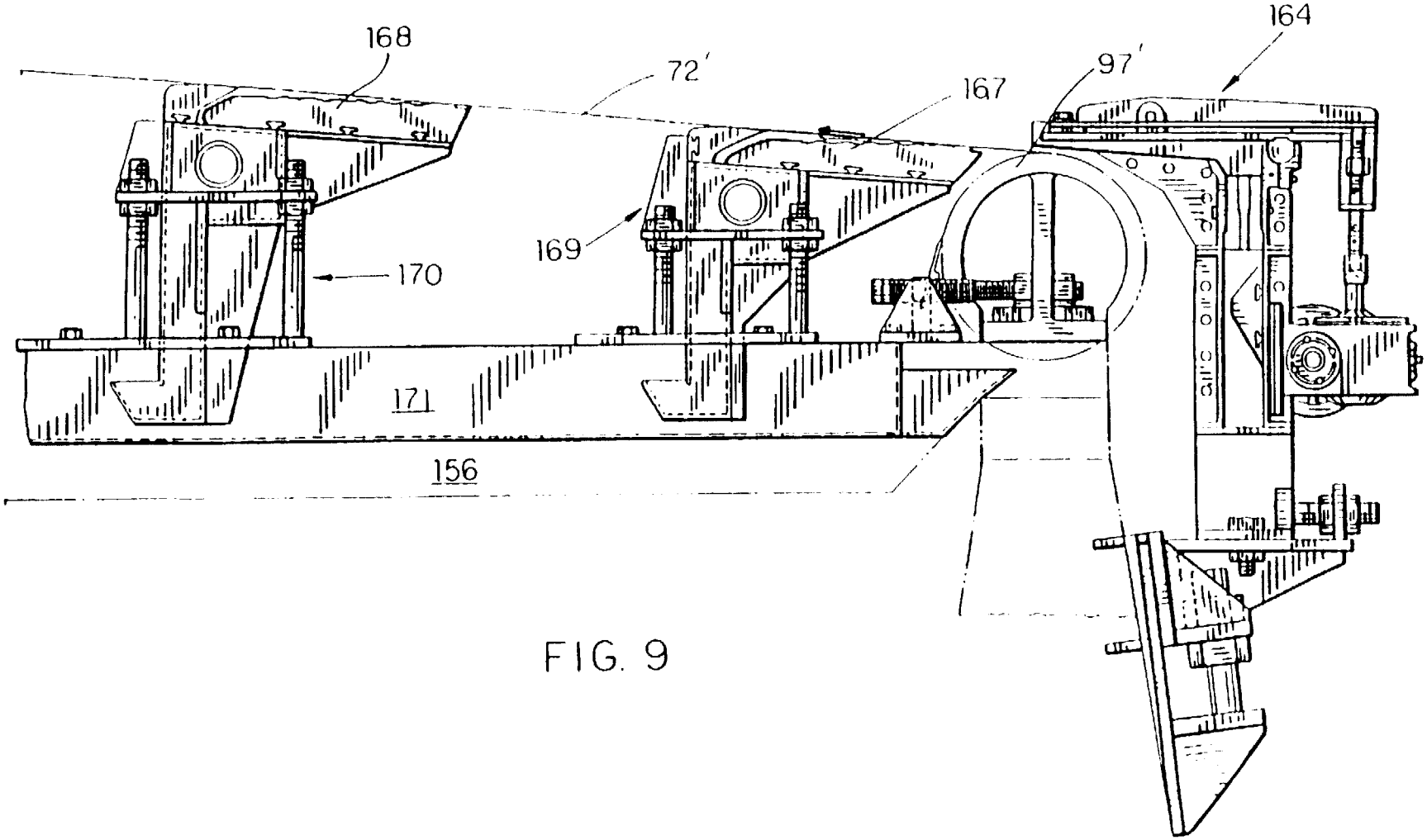
FIG. 9 is an enlarged elevation view of the drainage and forming blades along with the head box shown in FIG. 8.

As can be seen on FIGS. 8 and 9, in this embodiment the flat boxes have been removed. A series of drainage/activity blades (167 and 168) have been provided which are positioned on respective suction boxes (169 and 170) which are supported by the horizontal frame (156) over a collection pan (171) also supported by frame (156). Blades (167 and 168) provide activity to and also drainage from the sheet.

Figure 10A:
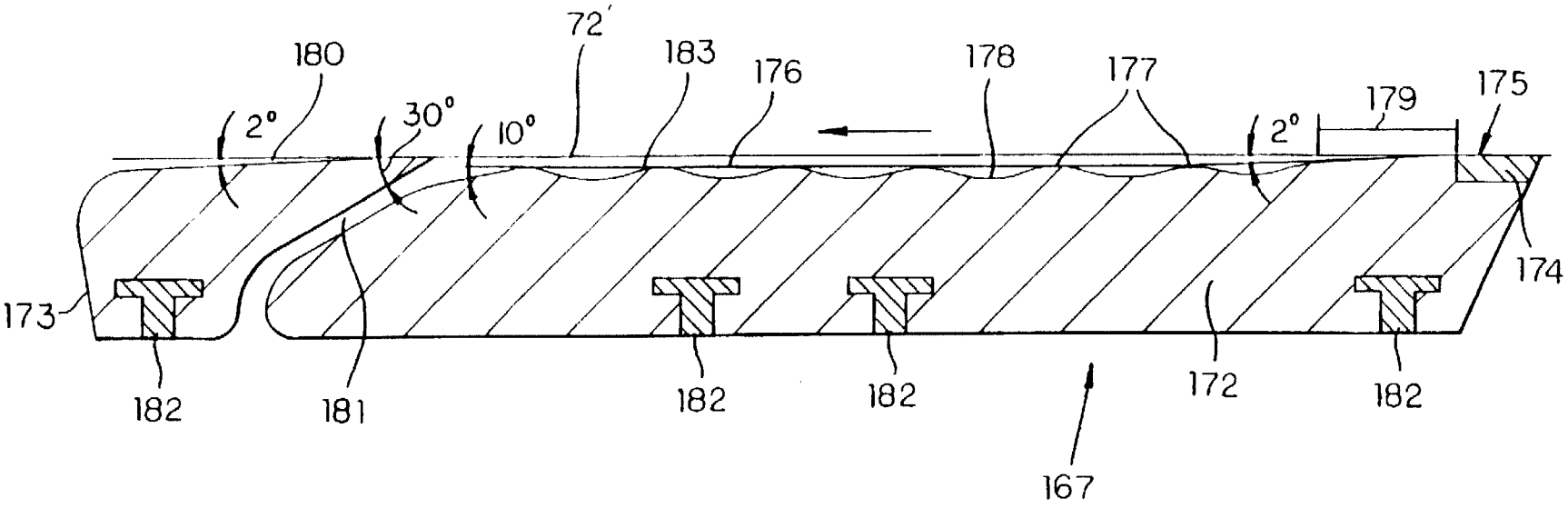
FIG. 10 and 10B are enlarged sectional view of the drainage and forming blade shown in FIG. 8.
Figure 10B:
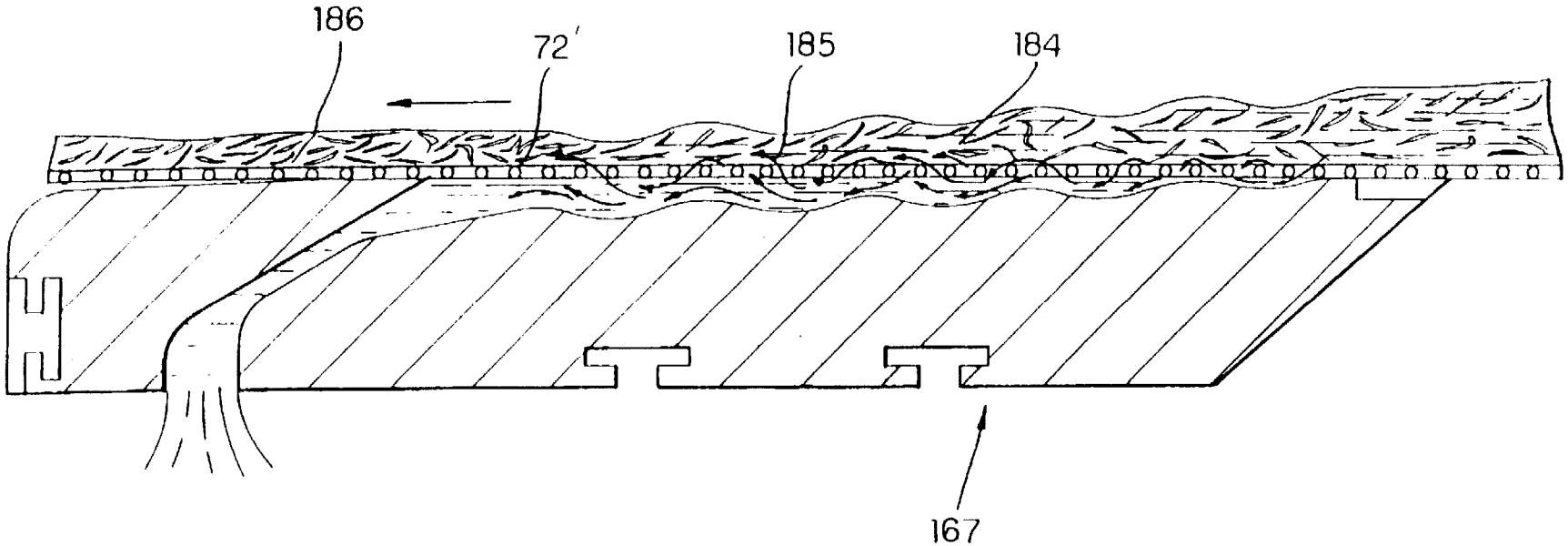

FIGS. 10A and 10B depict a more detailed representation of one of the blades or activity forming board (167). In this regard the blade comprises a primary blade (172) and a trail blade (173). Primary blade (172) may include an insert (174) at its leading edge or landing area (175) which may be made of a ceramic or wear resistant material or other suitable material. The leading edge (175) provides a support surface for the forming fabric (72') and is essentially flat and horizontal with respect thereto. Rearward of edge (175), the blade surface along line (176) diverges from the fabric (72') at an angle of approximately 2°. The leading edge (175) is followed by a series of smoothly formed raised areas (177) and recesses (178) beginning at a spaced distance (179) therefrom. In blade (167) as shown, the raised areas are approximately 1.5" apart from each other. Depending upon the speed of the machine, the recesses (178) can be greater or less to provide the desired amount of back flow while maintaining laminar flow.

Trail blade (173) is provided having an upper surface (180) which slopes downward away from the fabric (72') at approximately a 2° angle. The entire blade (167) is, for example, approximately 16 7/8" in length with the trail blade (173) being about 3 7/8". The primary blade (172) has a surface of about 13" adjacent the fabric (72'). Formed between the primary blade (172) and trail blade (173) is a gap (181) which at its mid-point is approximately 3/16" across.

Several conventional T mounts (181) are provided to slidably mount the blade (167) on suction box (169). This gap (181) provides for drainage of liquid from the fabric (72') and remains flooded during operation along with the space (183) between the primary blade (167) and fabric (72'). This will allow for a liquid to liquid transfer of water from the fabric (72').

The aforesaid dimensions and angles while desirable, are not critical.

The gap (181) size can be adjusted depending upon machine speed, stock consisting, stock retention and stock quality to achieve the desired amount of drainage. Using a narrow gap between the blades maximizes the drainage induced by a given drainage force by isolating the underside of the fabric from air by flooding the space between the fabric and the blade. The primary factor which determines the amount of water drained from the sheet is gap size. By using small gaps, the amount of water drained is relatively unaffected by either blade shape or box vacuum level.

While maintaining laminar flow the curved surface of the blade induces vertical flow velocity (i.e. up through the fabric and stock) beneficial to formation. The geometry of the blade to provide this while maintaining near laminar flow may be determined and defined by well known fluid flow over foil principles and equations and as set forth in the publication "Theory of Wing Sections" by Ira H. Abbott and Albert E. Von Doenltoff published by Dover Publications, Inc., (including, particularly, pages 110–115) and "Incompressible Aerodynamics" edited by Bryan Thwaites and published by Dover Publications, Inc., (including, particularly, pages 42–56).

FIG. 10B generally illustrates the expected flow pattern of the fluid drained from the stock (184) of material on the fabric (72'). Arrows (185) show the flow of liquid. As can be seen, a partial flow of liquid is caused to flow back through the fabric (72') into the stock (184) causing activity and dispersion of the fibers (186) making up the stock (184).

The blades may operate without the presence of external vacuum, or with limited vacuum as a primer during start up. A controlled vacuum could be provided to the suction boxes (169) and (170).

In the illustration in FIG. 9 the suction boxes (169) and (170) with blades follow the breast roll (97') and operate on the non-horizontal or inclined fabric (72'). The construction of blade (168) is the same as that of blade (167). Note the opposite ends of the blades (167 and 168) in the CD direction are sealed with deckles and the upper surface at the ends are flat.

The blade (167) acting in its dual capacity (i.e. drainage and activity) is able to remove approximately 65–80% of the water in the stock without sheet seal. The second blade (168) removes a small amount of water leaving the necessary water to provide improved ply bonding of sheets formed by successive units, if utilized.

After passing over the blades (167 and 168) the sheet travels until it reaches the nip between the couch roll (25') and support mold (32'). At this point the sheet is transferred to the underside of the horizontal papermakers fabric (73'). The sheet may then travel to another or a series of underwire forming units similarly constructed where further formed sheets are bonded thereto.

Figure 11:
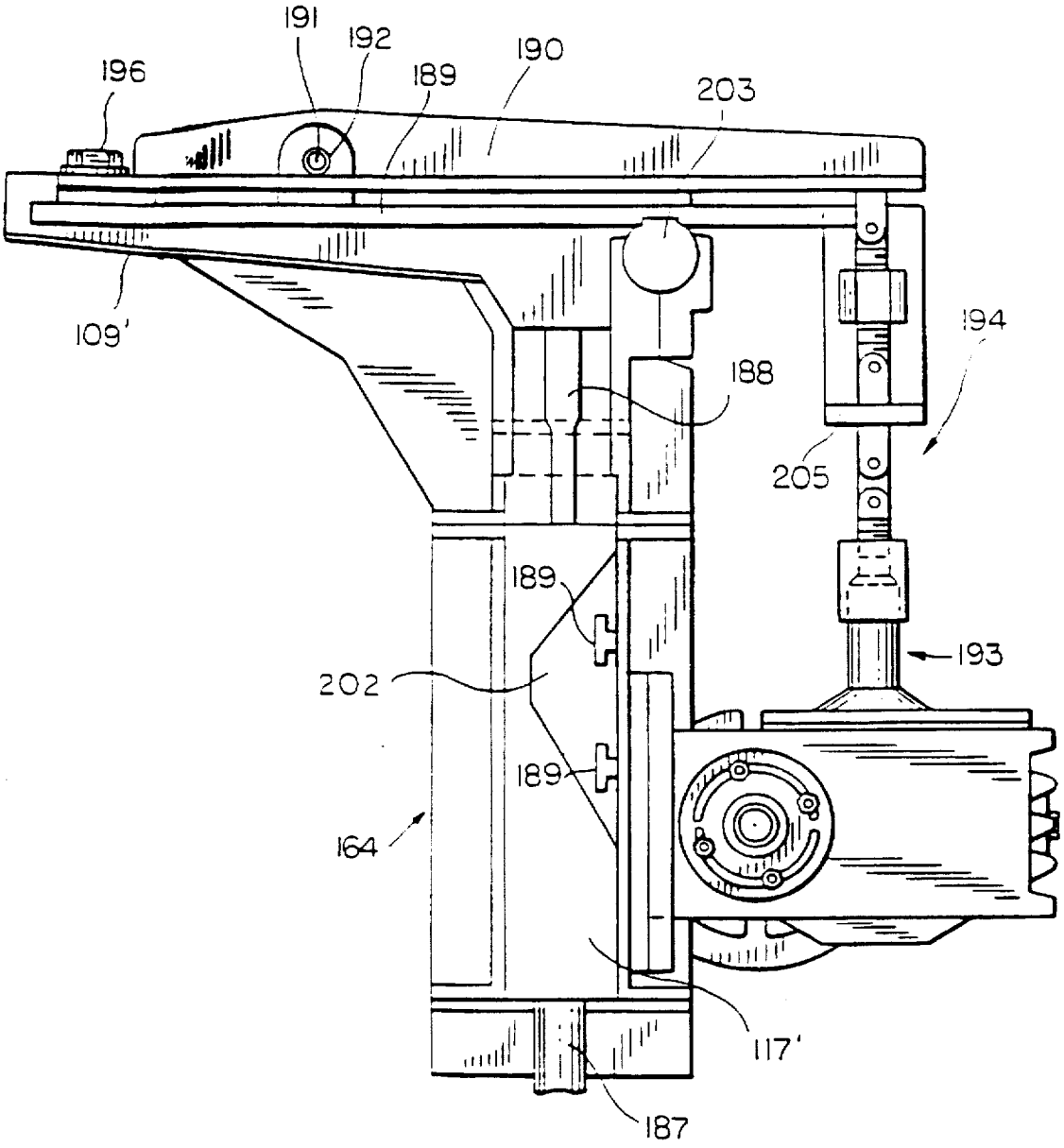
FIG. 11 is an enlarged sectional view of the head box shown in FIG. 8.
Figure 12C:
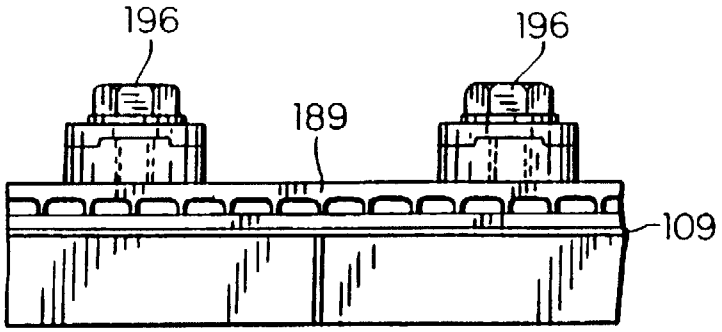
FIGS. 12A, 12B and 12C illustrate the activity lip as well as components thereof.
Figure 12A:
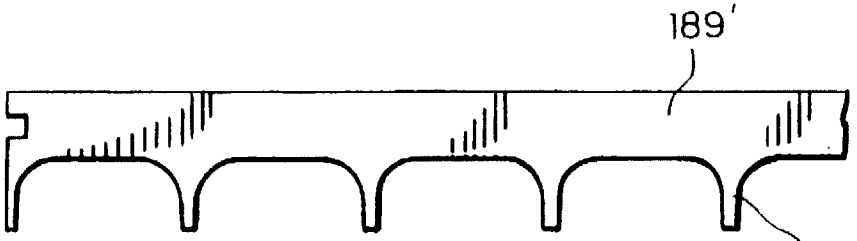
Figure 12B:
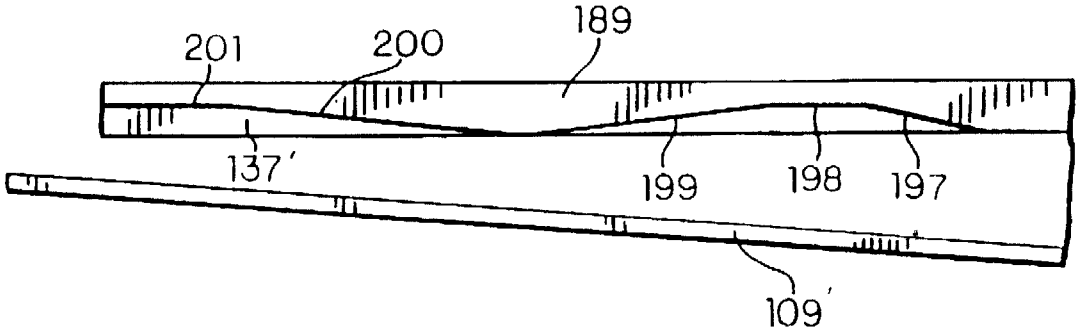
Figure 13:
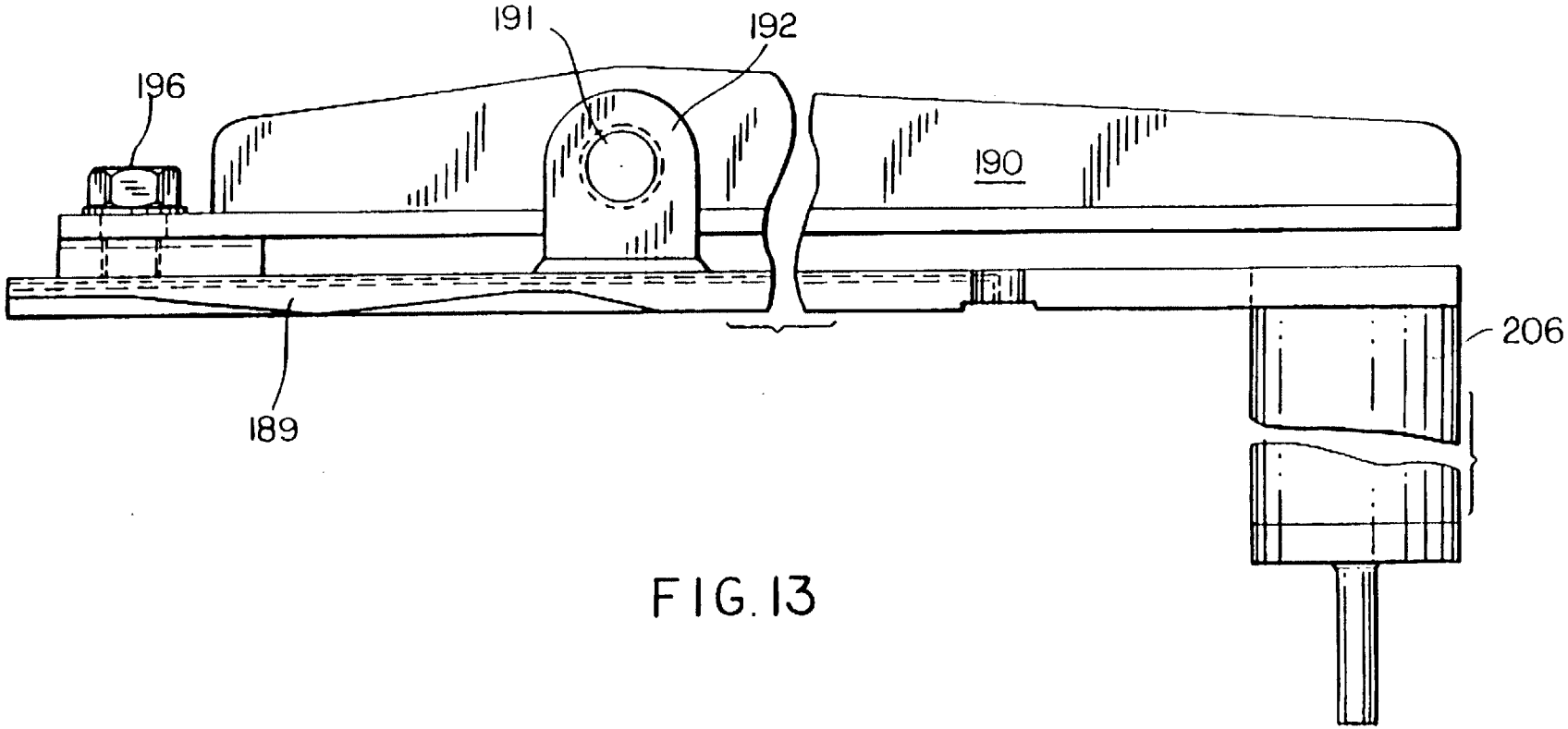
FIG. 13 illustrates the activity lip on the head box.
Figure 14:
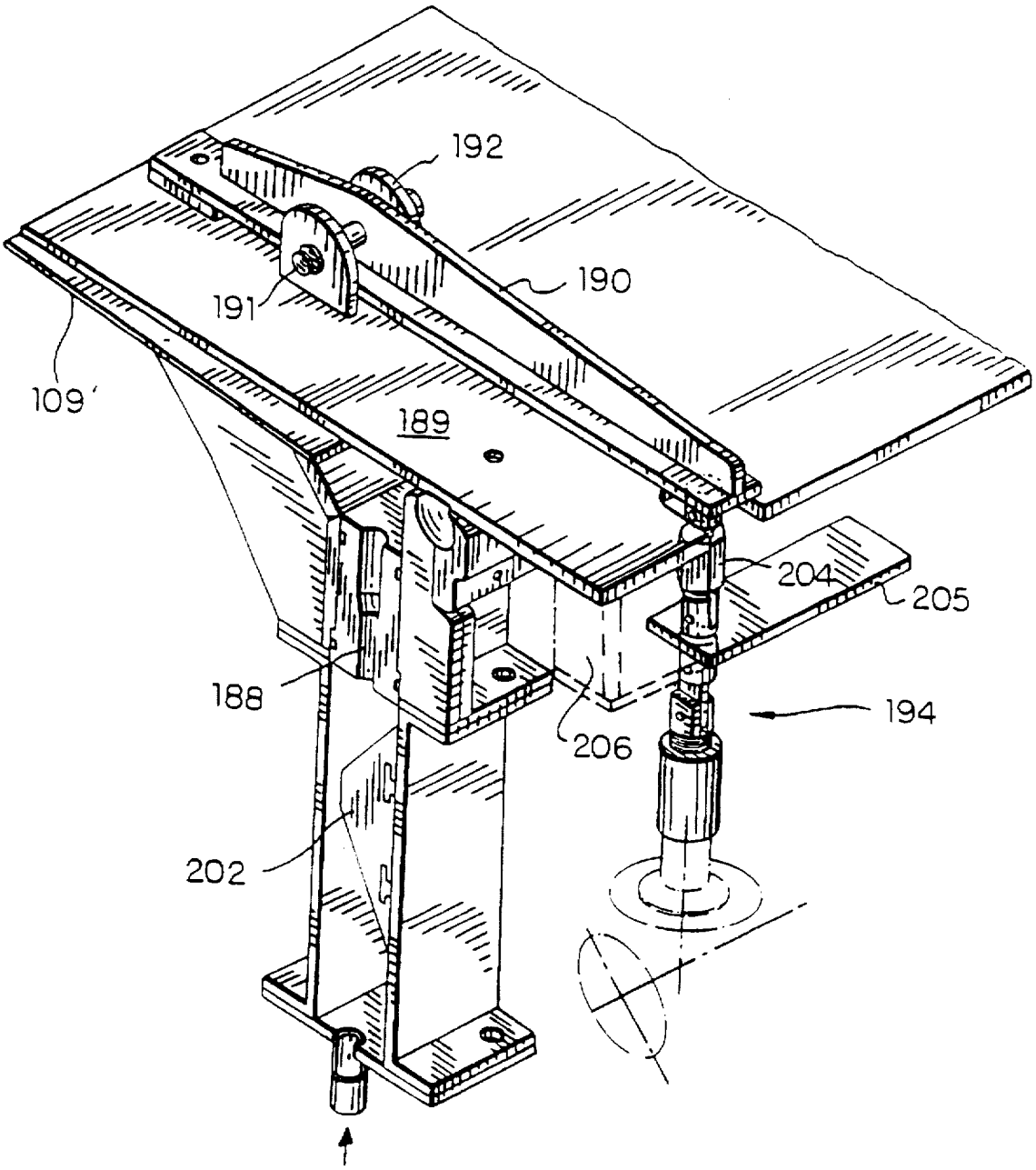
FIG. 14 is a partially sectional perspective view of the head box shown in FIG. 8.

Turning now to FIGS. 11 through 13 there is shown an alternative flow head box (164). The head box (164) distributes uniformly a flow of stock or fiber suspension in across the CD direction of the forming unit. A throat portion (117') is provided into which stock is fed via inlet (187). Positioned in the throat portion (117') is a raised trapezoidal shaped blade (202) preferably made out of a plastic material slidably maintained on T shaped blade holders (189). Portion (117') runs the length of head box (164) in the CD direction and serves to reduce turbulence of the stock passing thereby. Coupled to the throat portion (117') is a step diffuser (188).

The head box (164) has a lower lip (109') and an upper activity lip (189). The upper lip (189) is coupled to a support member (190) which pivots about bearing (191) supported by member (192) which is mounted to lip (189). A plurality of adjustment devices (204) are coupled to support member (205) which is fixedly attached via members (206) to lip (189) and are positioned at spaced intervals along the CD direction of the rear of the lip (189) to allow to flex or pivot the lip (189) about bearing (191) by the individual adjustment thereof. The lip (189) is coupled at each end to an adjustment mechanism (193) (only one of two are shown) which is coupled therewith via a link arrangement (194) to support member (205). This allows the position of the whole activity lip (189) to be adjusted with respect to the lower lip (109) by the pivoting of the same about pivot point (203). Adjusting the distance therebetween controls and affects the discharge flow. The activity lip (189) is also coupled to support (190) by way of retaining nuts (196). As with the prior embodiment, and as now shown in FIGS. 12A–12C and 13, the upper activity lip (189) has a profile designed to create activity in the fiber suspension and which is able to create turbulence to orient high concentration of fibers; it also allows obtaining a paper of lower density. This profile comprise an inclined part (197) and a straight part (198) adjacent inclined parts (199 and 200) and a straight part (201). These cause a change in the speed (increased space causes slower speed, or velocity decreased space causes greater speed or velocity) in the flow of the fiber suspension, both horizontally and vertically along with flow in the CD direction. The activity profile is spaced widthwise of the head box by means of sectors (137') spaced for example approximately 0.5" apart with a depth of approximately 0.2" keeping the same thickness of the upper activity lip. The upper activity lip internally generated hydraulic pattern produces crossed flows over the forming table at the time the fiber suspension leaves the head box. This causes the fiber orientation to be improved transversely, that is the fiber orientation ratio in the machine direction to the transversal fiber orientation decreases. In this way, the values of the physical properties of the paper in the transversal sense tends to be similar to those in the machine sense.

The head box (164) allows the stock to be distributed without affecting the basis weight profile due to speed or grade change. The activity lip (189) creates activity and avoids streaking appearance of the sheet. The use of the blades (167 and 168) in combination with the head box (164) causes a freeze formation in the sheet and avoids roll back with drainage not being limited. Note also that the angle between the papermakers fabric (73') and fabric (72') in the first embodiment is approximately 10° where as in the second embodiment is approximately 5°. The lesser angle allows for increased speed of the fabric.

Thus by the present invention its advantages will be realized and although preferred embodiments have been disclosed and described in detail herein, its scope should not be limited thereby rather its scope should be determined by that to the appended claims.

I claim:

1. An under felt inclined former in a papermaking machine, said former comprising:

a breast roll;

a support roll downstream of the breast roll;

a forming fabric;

a drainage means positioned between the breast roll and support mold for drainage of liquid from the forming fabric; said breast roll, support roll, forming fabric and drainage means being positioned under a papermaking felt on a papermaking machine;

said forming fabric engaging said breast roll and support roll in an endless loop and passing over said drainage means which removes liquid from stock on the forming fabric and activity means which creates activity in the stock;

said drainage means includes activity means which forces a portion of drained back through the fabric to cause activity in the stock therein whilst allowing draining liquid therefrom;

a couch roll positioned above a papermaking felt and above said support roll to cause said papermaking felt to engage the forming fabric so as to allow a transfer of a sheet formed on the forming fabric to said papermaking felt;

said drainage means and forming fabric being inclined with respect to said papermakering felt;

a head box positioned at the beginning of the forming fabric for placing stock thereon; and wherein stock is introduced onto the forming fabric by the head box which, due to a rotation of the breast roll and support mold, causes the forming fabric to pass over the drainage means causes stock activity and liquid to be drained from the stock forming a sheet which is then transferred to the papermaking felt at a junction formed between the couch roll and support roll.

2. The under felt inclined flat former in accordance with claim 1 wherein the activity means comprises at least one activity forming blade.

3. The under felt inclined flat former in accordance with claim 2 further comprising activity inducing means located at the head box for inducing activity and dispersion of stock prior to flowing on to the forming fabric.

4. The under felt inclined flat former in accordance with claim 3 wherein the activity inducing means comprises an upper activity lip located at the head box for creating activity in the stock as it is fed on to the forming fabric.

5. The under felt inclined flat former in accordance with claim 2 wherein said head box comprises a stepped diffuser which maintains the stock in a state of dispersion.

6. The under felt inclined flat former in accordance with claim 2 wherein said support roll is a cylinder mold.

7. The under felt inclined flat former in accordance with claim 2 wherein said former includes support means for supporting said former under a papermaking felt and includes means for pulling the support roll away from under a papermaking felt without stopping production thereon.

8. The under felt inclined flat former in accordance with claim 2 which includes a plurality of under felt inclined formers which are positioned in series and are used in the formation of a sheet.

9. An under felt inclined former a papermaking machine, said former comprising:

a breast roll;

a support roll downstream of the breast roll;

a forming fabric;

a drainage means positioned between the breast roll and support roll for drainage of liquid from the forming fabric; said breast roll, support roll, forming fabric and drainage means being positioned under a papermaking felt;

said forming fabric engaging said breast roll and support roll in an endless loop and passing over said drainage means which removes liquid from stock on the forming fabric;

a couch roll positioned above said papermaking felt and above said support roll to cause a papermaking felt to engage the forming fabric so as to allow a transfer of a sheet formed on the forming fabric to said papermaking felt;

said drainage means and forming fabric being inclined at an angle of approximately 10 degrees or less with respect to a papermakering felt;

said drainage means includes an activity means which forces a portion of liquid drained back through the fabric to cause activity in the stock therein whilst allowing draining liquid therefrom;

a head box positioned at the beginning of the forming fabric for placing stock thereon; and wherein stock is introduced onto the forming fabric by the head box which, due to a rotation of the breast roll and support roll causes the forming fabric to pass over the drainage means which causes liquid to be drained from the stock forming a sheet which is then transferred to the papermaking felt at a junction formed between the couch roll and support roll.

10. The under felt inclined flat former in accordance with claim 9 wherein the angle of inclination is approximately 5 degrees.

11. The under felt inclined flat former in accordance with claim 9 wherein the activity means comprises at least one activity forming blade.

12. The under felt inclined flat former in accordance with claim 9 further comprising activity inducing means located at the head box for inducing activity and dispersion of stock as it is fed on to the forming fabric.

13. The under felt inclined flat former in accordance with claim 12 wherein the activity inducing means comprises an upper activity lip located at the head box for creating activity in the stock as it is fed onto the fabric.

14. The under felt inclined flat former in accordance with claim 9 wherein said head box comprises a stepped diffuser which maintains the stock in a state of dispersion.

15. The under felt inclined flat former in accordance with claim 9 wherein said support roll is a cylinder mold.

16. The under felt inclined flat former in accordance with claim 9 wherein said former includes support means for supporting said former under a papermaking felt and includes means for pulling the support roll away from under a papermaking felt without stopping production thereon.

17. The under felt inclined flat former in accordance with claim 9 which includes a plurality of under felt inclined formers which are positioned in series and are used in the formation of a sheet.

18. An under felt inclined former in a papermaking machine, said former comprising:

a breast roll;

a support roll downstream of the breast roll;

a forming fabric;

a drainage means positioned between the breast roll and support roll for drainage of liquid from the forming fabric; said breast roll, support roll, forming fabric and drainage means being positioned under a papermaking felt;

said forming fabric engaging said breast roll and support roll in an endless loop and passing over said drainage means which removes liquid from stock on the forming fabric;

a couch roll positioned above said papermaking felt and above said support roll to cause said papermaking felt to engage the forming fabric so as to allow a transfer of a sheet formed on the forming fabric to said papermaking felt;

said drainage means and forming fabric being inclined with respect to said papermakering felt;

said drainage means includes an activity means which forces a portion of liquid drained back through the fabric to cause activity in the stock therein whilst allowing draining liquid therefrom;

a head box positioned at the beginning of the forming fabric for placing stock thereon;

activity inducing means located at the head box for inducing activity and dispersion of stock prior to the flowing on to the forming fabric; said activity inducing means comprising an activity lip which causes a variation of the velocity of the flow as the stock flows in a machine direction; and wherein stock is introduced onto the forming fabric by the head box which, due to a rotation of the breast roll and support roll, causes the forming fabric to pass over the drainage means which causes activity and liquid to be drained from the stock forming a sheet which is then transferred to the papermaking felt at a junction formed between the couch roll and support roll.

19. The under felt inclined flat former in accordance with claim 18 wherein the activity means comprises at least one activity forming blade.

20. The under felt inclined flat former in accordance with claim 19 wherein the drainage means and forming fabric are inclined at an angle of approximately 5 degrees with respect to the papermakers felt.

21. The under felt inclined flat former in accordance with claim 18 wherein said support roll is a cylinder mold.

22. The under felt inclined flat former in accordance with claim 18 wherein said head box comprises a stepped diffuser which maintains the stock in a state of dispersion.

23. The under felt inclined flat former in accordance with claim 18 wherein said former includes support means for supporting said former under a papermaking felt and includes means for pulling the support roll away from under a papermaking felt without stopping production thereon.

24. The under felt inclined flat former in accordance with claim 18 which includes a plurality of under felt inclined formers which are positioned in series and are used in the formation of a sheet.

* * * * *

UNITED STATES PATENT AND TRADEMARK OFFICE

CERTIFICATE OF CORRECTION

PATENT NO. : 5,766,420

DATED : June 16, 1998

INVENTOR(S) : Luis Fernando Cabrera y Lopez Caram

It is certified that error appears in the above-identified patent and that said Letters Patent is hereby corrected as shown below:

On page 1 item [73] Assignee should be changed from "Smurfut Carton y Papel De Mexico" to --Smurfit Carton y Papel De Mexico--.

Signed and Sealed this

Third Day of November, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,766,420

DATED : June 16, 1998

INVENTOR(S) : Luis Fernando Cabrera y Lopez Caram

It is certified that error appears in the above-identified patent and that said Letters Patent is hereby corrected as shown below:

Column 5, line 59 "371" should be --37'--;
Column 8, line 38 "mold" should be --roll--;
Column 8, line 48, "of" should be --of liquid--;
Column 8, line 63 "mold" should be --roll--; and
Column 9, line 26 "former" should be --former in--.

Signed and Sealed this

Twenty-fourth Day of August, 1999

*Attest:*

Q. TODD DICKINSON

*Attesting Officer*

*Acting Commissioner of Patents and Trademarks*